United States Patent [19]

Hume

[11] Patent Number: 4,739,219

[45] Date of Patent: Apr. 19, 1988

[54] ELECTRIC LAMP WITH PINCH SEALED OUTER CONDUCTOR OF NON-HIGHLY REFRACTORY MATERIAL

[75] Inventor: Roger A. Hume, Ohn, England

[73] Assignee: Thorn Emi plc, London, England

[21] Appl. No.: 80,141

[22] Filed: Jul. 29, 1987

Related U.S. Application Data

[63] Continuation of Ser. No. 798,291, Nov. 15, 1985, abandoned.

[30] Foreign Application Priority Data

Nov. 24, 1984 [GB] United Kingdom ..... 8429740

[51] Int. Cl.[4] ..... H01J 1/05; H01J 61/06; H01J 61/36; H01K 1/40

[52] U.S. Cl. ..... 313/623; 313/633; 313/579

[58] Field of Search ..... 313/623, 633, 578, 579

[56] References Cited

U.S. PATENT DOCUMENTS 4,039,883 8/1977 Damsteeg et al. ..... 313/633
4,219,757 8/1980 Rech et al. ..... 313/623

FOREIGN PATENT DOCUMENTS 776972 6/1957 United Kingdom .
882190 11/1961 United Kingdom .
1023137 3/1966 United Kingdom .
1302340 1/1973 United Kingdom .
1301966 1/1973 United Kingdom .
1470909 4/1977 United Kingdom .
1537506 12/1978 United Kingdom .

*Primary Examiner*—David K. Moore
*Assistant Examiner*—Kenneth A. Wieder
*Attorney, Agent, or Firm*—Fleit, Jacobson, Cohn & Price

[57] ABSTRACT

A lead wire arrangement used in the pinch seal of a tungsten halogen incandescent or air burning discharge lamp. The outer lead wires are made of an oxidation resistant material having a melting point significantly lower than the temperature surrounding the foil and lead wire arrangement during the pinch sealing process. Because the temperature reached during pinch sealing is of the order 2,000° C. conventionally outer lead wires have been made of a highly refractory material, for example, molybdenum which has to be coated with platinum to prevent oxidation. The invention uses materials having significantly lower melting points than 2,000° C. which are also oxidation resistant thus avoiding the use of the expensive platinum. Suitable materials for the outer lead wires include titanium wire, titanium coated wire, nickel/iron alloys and titanium/molybdenum alloys.

19 Claims, 1 Drawing Sheet

ELECTRIC LAMP WITH PINCH SEALED OUTER CONDUCTOR OF NON-HIGHLY REFRACTORY MATERIAL

This application is a continuation of application Ser. No. 798,291 filed Nov. 5, 1985 now abandoned.

This invention relates to lead wires used in association with pinch seals in fused silica (quartz), high silica content glass or high melting point aluminosilicate or borosilicate glass or similar materials for achieving electrical connection into a sealed envelope made of the said material. The invention is particularly but not exclusively related to tungsten halogen incandescent lamps and to air burning discharge lamps (one example being compact source iodide lamps) using quartz/metal seals for electrical lead-throughs.

In such lamps it is well known to use the so-called pinch-seal in which the internal electrical connections of the lamp and the external or outer lead wire are both welded to a length of foil usually molybdenum which is placed within a tube of the envelope material which is then heated and pinched between suitable pinching apparatus including pinching jaws and a die block support. Advantageously the foil may be feather edged. This method of sealing is particularly suitable where the envelope material is pure fused silica or similar materials with a silica content of greater than 96% (such as the material known by the Registered Trade Mark VYCOR) as is necessary for tungsten halogen cycle incandescent lamps.

Temperatures of the envelope material surrounding the foil and leadwire assembly during the pinch sealing process can momentarily reach 2000° C. Consequently it is conventional to use an external lead wire of a highly refractory material, typically molybdenum (melting point 2430° C.).

The maximum operating temperature of lamps made by those techniques is limited by oxidation of the foil and/or the lead wire. However molybdenum oxidises in air at about 350° C., but in many applications this is below the required operating temperature of the seal. Oxidation is normally prevented in such cases by coating the outside of the outer or external lead wire with platinum. This has proved successful and has been used now for many year. However platinum is an extremely expensive material so that it would be desirable to reduce the extent of its use and for that reason some considerable effort has been expended in attempting to find a replacement for this purpose but hitherto without effect.

Materials which have been tried include molybdenum disilicide, phosphates, silica, alumina and a number of cermets and ceramics. None of these have successfully solved the oxidation problem.

According to the present invention there is provided a lead wire arrangement for sealing in a pinch seal, the arrangement including a sealing foil having joined thereto an outer lead wire which is, at least at the surface, made of an oxidation resistant material having a melting point lower than the temperature surrounding the foil and lead wire arrangement during a pinch sealing process.

In a preferred embodiment of the invention the oxidation resistant material has a melting point lower than 2000° C. because this is a temperature commonly reached during pinch sealing.

In a preferred embodiment of the invention there is provided a lead wire arrangement in a pinch seal, the arrangement including a hermetic sealing member having joined thereto an outer lead wire which is, at least, at the surface made of titanium or a suitable titanium alloy. Titanium being a preferred material because it is so readily obtainable.

According to a further embodiment of the invention there is provided a method of pinch sealing which includes the step of using for the outer lead wire a material which is oxidation resistant and has a melting point lower than the temperature surrounding the foil and lead wire during a pinch sealing process.

The method of pinch sealing referred to in this invention has to be distinguished from other methods of sealing, for example the method of sealing disclosed in UK Pat. No. 776,972, published June 12, 1957. UK Pat. No. 776,972 discloses the use of titanium as a sealing element in a hermetic glass to metal seal wherein the coefficient of expansion of the metal must be matched to the glass and the technique is restricted to low melting point glasses and sealing temperatures of around 500° C. Pinch sealing, on the other hand, is a non-matched foil type seal which requires the adhesion forces at the quartz/metal interface to withstand the expansion and contractions stresses in the thin section foil. When used in the context of tungsten halogen incandescent lamps, pinch seals are made with lamp envelope materials containing in excess of 95% silica and almost negligible expansion, for example, less than $8\times10^{-7}$°C.$^{-1}$. In pinch sealing the sealing temperature can reach 2000° C. It especially has to be borne in mind that, in the present invention, the titanium is being used for the outer lead wires and not to form the hermetic part of the seal which is the function of the foil.

The invention will now be described by way of example only and with reference to the accompanying drawings wherein.

Figure 1:
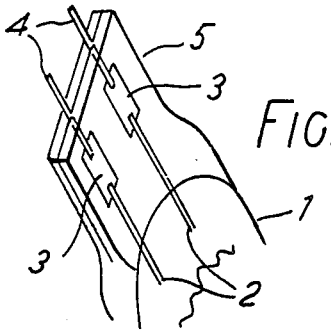
FIG. 1 is a perspective view of a pinch seal arrangement embodying the invention.

FIG. 1 shows a pinch seal of a quartz lamp envelope 1 in this case having two lead-ins at one end although one or more may be provided. In conventional manner the internal electrical connections 2 are welded to molybdenum foils 3 to which are also welded external lead wires 4. These are sealed in the pinch 5.

It can readily be seen that a significant portion of the lead wires 4 is within the pinch or close to it so that it will be subject to the high temperatures required for pinch selaing. For that reason it has previsouly been considered a necessary criterion of the search for alternative materials for outer lead wires that they should be highly refractory.

We have now found that a number of non highly refractory materials are suitable, including titanium, NILO K, and Fecralloy (the latter two being commercial nickel/iron alloys). This is a surprising result since all these materials melt at temperatures in the region of 1350° C. to 1670° C. which is relatively low in comparison to the pinching temperature and melting point of molybdenum and would not normally be expected to survive the pinching process. Titanium is preferred to either NILO K or Fecralloy because of its slightly higher melting point. On the other hand NILO K and Fecralloy are advantageous in having a lower resistivity than titanium.

It is believed that the success of the method in the face of high temperatures results from the dynamic and transient nature of the temperature rise in the pinch sealing process. That is to say although the temperature does reach 2000° C. during the one or two seconds of the impacting of the pinching jaws, the thermal inertia of these materials is sufficient to prevent excessive melting or evaporation and thus allow the use of a relatively low melting point material for the outer lead wires of the pinch seal. The fact that the low melting point material is also oxidation resistant and substantially less costly than platinum is an additional advantage.

Although the thermal inertia of suitable materials can be relatively easily found it should be borne in mind that successful practice of the present invention requires also consideration of material compatability and the heat sinking effect of the apparatus as well as the specific dimensions of any particular pinch seal arrangement. A successful pinch seal will be judged when the seal has been made and melting and/or evaporatin of the pinch seal material has been prevented. This will be within the scope of a person skilled in this art.

The invention may be used with solid titanium wire or conventional molybdenum wire plated with titanium which would give considerable cost savings. It will be appreciated that materials other than those specified with similar melting points and suitable thermal masses may be used.

It is also thought that there might be advantage in giving the titanium or titanium coated wire a flash coating of platinum to prevent wetting of the quartz, this being siginificantly less costly than platinum plating. A polished surface finish is preferred which helps avoid any cracking problem. In this specification references to the surface of the lead wire being of titanium or similar material is intended to include surface coatings of thickness 0.05 mm or less where the coating is of metals such as platinum or nickel or for a non-metal refractory material, such as alumina, the coating thickness would be 0.25 mm or less.

Figure 2:
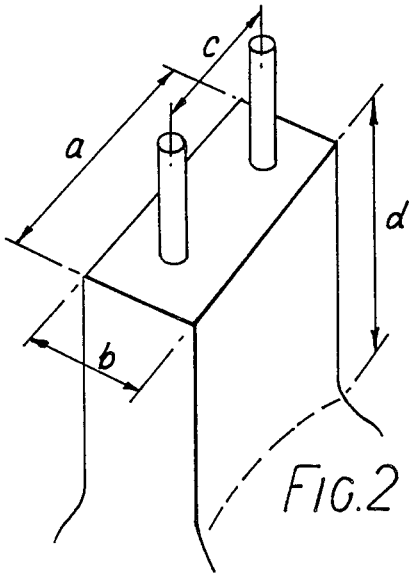
FIG. 2 is a perspective view on the outside of a pinch seal incorporating the invention.

FIG. 2 illustrates pinch seal arrangements in accordance with the invention and having dimensions in accordance with the following table:

| Example | Lead Wire (Outer) Material | Lead Wire (Outer) Diameter (mm) | a | b | c | d | Foil Thickness (mm) |
|---|---|---|---|---|---|---|---|
| 1 | Titanium | 1 | 22 | 3 | 6 | 16 | 0.033 |
| 2 | Titanium | 1 | 28 | 3 | 6 | 22 | 0.033 |
| 3 | NILO K | 1 | 18 | 3 | 6 | 17 | 0.033 |
| 4 | Fecralloy | 0.7 | 18 | 3 | 6 | 17 | 0.033 |
| 5 | 85Ti/15Mo | 0.7 | 22 | 3 | 6 | 16 | 0.033 |

In example 5, the outer lead wire was made of an alloy of titanium and molybdenum. An alloy of 85% by weight of titanium and 15% by weight of molybdenum was particularly useful because it reduced the tendency of the quartz to stick to the outer lead wire material. This in turn lessened the possibility of inter facial cracking. Also the presence of molydenum was found to give a useful small increase in the melting temperature of the alloy compared to pure titanium.

Figure 3:
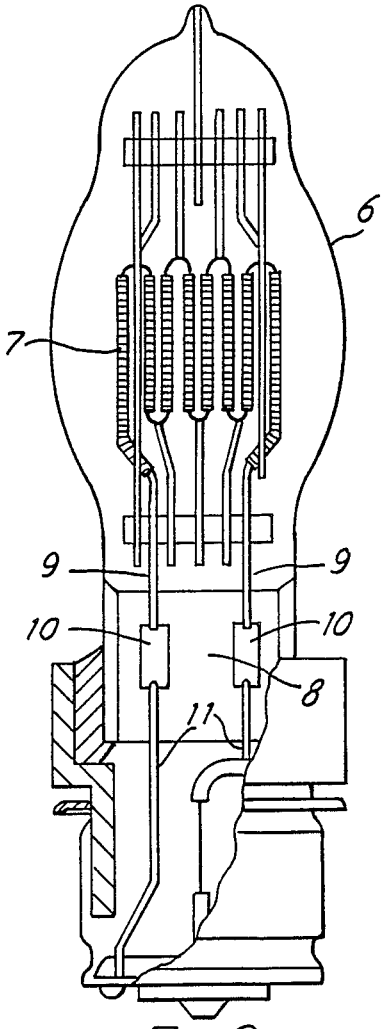
FIG. 3 is one version of a tungsten halogen incandescent lamp incorporating the invention.

FIG. 3 illustrates an example of a typical single ended tungsten halogen incandescent lamp having a quartz envelope 6, filament 7 and pinch seal arrangment 8 including inner lead wires 9 attached to molybdenum foil seal member 10. In accordance with the present invention outer lead wires 11, attached to respective foils 10 are each made of titanium wire.

Figure 4:
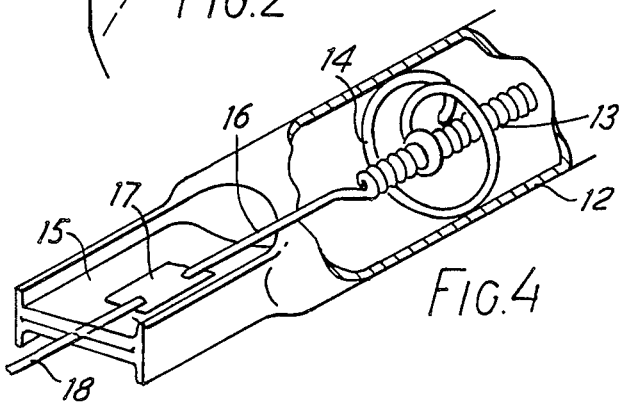
FIG. 4 is another version of a tungsten halogen incandescent lamp incorporating the invention.

FIG. 4 illustrates an example of one end section of a typical quartz linear tungsten halogen incandescent lamp. This comprises quartz envelope 12, linear filament 13 with tungsten spiral support 14, pinch seal arrangement 15, including inner lead wire 16 attached to molybdenum foil seal member 17. In accordance with the present invention outer lead wire 18 attached to foil 17 is made of titanium wire.

I claim:

1. A lead wire arrangement for sealing in a pinch sealed envelope of an electric lamp, the arrangement including a sealing foil having joined thereto an outer lead wire which is, at least at the surface, made of oxidation resistant material selected from the group consisting of titanium and titanium/molybdenum alloys and having a melting point lower than 2000° C.

2. A lead wire arrangement according to claim 1 wherein the melting point is between 1350° and 1670°.

3. A lead wire arrangement according to claim 1 wherein the oxidation resistant material is titanium.

4. A lead wire arrangement according to claim 3 wherein the titanium comprises titanium wire.

5. A lead wire arrangement according to claim 3 wherein the outer lead wire comprises a wire of refractory material coated with titanium.

6. A lead wire arrangement according to claim 4 wherein the titanium wire is coated with a metal.

7. A lead wire arrangement according to claim 6 wherein the metal is selected from the group consisting of platinum or nickel.

8. A lead wire arrangement according to claim 7 wherein the thickness of the coating is 0.05 mm or less.

9. A lead wire arrangement according to claim 4 wherein the titanium wire is coated with a non metal refractory material.

10. A lead wire arrangement according to claim 9 wherein the coating thickness is 0.25 mm or less.

11. A lead wire arrangement according to claim 3 wherein the titanium is flash coated with platinum.

12. A lead wire arrangement according to claim 1 wherein the outer lead wire has a polished surface finish.

13. A lead wire arrangement according to claim 1 in a pinch seal made from a material selected from fused silica, high silica content glass, high melting point aluminosilicate or borosilicate glass.

14. A lead wire arrangement according to claim 1 wherein the oxidation resistant material is a titanium/-molybdenum alloy.

15. A lead wire arrangement according to claim 14 wherein the alloy is 85% titanium and 15% molybdenum by weight.

16. A tungsten halogen incandescent lamp comprising a lead wire arrangement according to claim 1.

17. An air burning discharge lamp having a lead wire arrangement according to claim 1.

18. In an electric lamp having an envelope closed by a pinch seal arrangement, the pinch seal arrangement comprising a foil seal having attached thereto an outer conductor, the improvement wherein the outer conductor comprises a non highly refractory material selected from the group consisting of titanium and titanium/-molybdenum alloys, said non-highly refractory material being also oxidation resistant and having a melting point lower than 2000° C.

19. The lamp according to claim 18 wherein the non highly refractory material comprises an alloy of 85% titanium by weight and 15% molybdenum by weight.

* * * * *